United States Patent [19]

Glickman

[11] Patent Number: 4,936,712

[45] Date of Patent: Jun. 26, 1990

[54] RETAINING WALL SYSTEM

[75] Inventor: Michael N. Glickman, London, England

[73] Assignee: McCauley Corporation Limited, London, England

[21] Appl. No.: 5,246

[22] Filed: Jan. 20, 1987

[30] Foreign Application Priority Data

Jan. 21, 1986 [GB] United Kingdom ..... 8601425

[51] Int. Cl.[5] ..... E02D 29/02

[52] U.S. Cl. ..... 405/284; 52/604; 52/608; 405/286

[58] Field of Search ..... 405/284, 285, 286, 287; 52/245, 604, 608; 446/115, 117, 120, 124, 125

[56] References Cited

U.S. PATENT DOCUMENTS

| | | | |
|---|---|---|---|
| 230,829 | 8/1880 | Shear et al. | 52/245 |
| 1,676,385 | 7/1928 | Colwell | 52/245 X |
| 2,818,248 | 12/1957 | Kelsey | 52/604 X |
| 3,483,704 | 12/1969 | Tabor | 52/245 |
| 3,570,253 | 3/1971 | Vidal | 405/284 |
| 4,448,571 | 5/1984 | Eckels | 405/284 |
| 4,490,075 | 12/1984 | Risi et al. | 405/273 |
| 4,521,138 | 6/1985 | Steiner | 405/284 |
| 4,524,551 | 6/1985 | Scheiwiller | 405/286 X |
| 4,787,185 | 11/1988 | Gascho | 405/284 X |

FOREIGN PATENT DOCUMENTS

| | | |
|---|---|---|
| 1182295 | 2/1985 | Canada . |
| 1915347 | 11/1970 | Fed. Rep. of Germany . |
| 2111652 | 9/1972 | Fed. Rep. of Germany . |
| 2243304 | 9/1973 | France . |
| 2575268 | 6/1986 | France . |
| 2157733 | 10/1985 | United Kingdom . |

OTHER PUBLICATIONS

SF Cooperation GmbH, Pamphlet, 4 pp.
RBS Brooklyns, Pamphlet for Kriblok, 6 pages.

*Primary Examiner*—David H. Corbin
*Attorney, Agent, or Firm*—Renner, Otto, Boisselle & Sklar

[57] ABSTRACT

A retaining wall system has a number of units placed on top of the other. The units are constructed to be capable of interengaging one another in a plurality of selected positions so that the angle of the face of the resulting wall to the vertical can be different at different heights. Preferably the upper surface of each unit is substantially convex and the lower surface of each unit is a substantially complementary concave configuration. The blocks engage complementarily in more than one possible relative position and are shaped to resist being displaced therefrom by lateral forces.

14 Claims, 7 Drawing Sheets

RETAINING WALL SYSTEM

FIELD OF THE INVENTION

This invention relates to a retaining wall system and to wall units for use in such a system. The invention also relates to a noise barrier or baffle, or to a planter wall, or to a so-called "Bund" wall. For brevity of description in this specification, the term "retaining wall system" is considered to include these possibilities.

BACKGROUND OF THE INVENTION

There have been proposals for wall systems for retaining soil or earth or other material, e.g. landfill. Wall systems have also been proposed for use in landscaping and terracing so that better use can be made of hilly sites, and are needed for embankments used in highway construction.

Among the more desirable qualities of a retaining wall system are 1. it should employ a minimum number of different kinds of blocks or units;
2. it should be such that it can be constructed on a simple horizontal-surfaced foundation pad;
3. the geometry of each unit or block should be such that it gives rise to substantial resistance to shear forces or forces which might give rise to movement lateral to the length of the wall.
4. it should not require complex methods or equipment to anchor or tie the wall units back into the fill material; and
5. the units should permit simple and rapid construction of retaining walls at various (and varying) angles (including zero degrees) to the vertical.

To the best of the present Applicant's knowledge and belief, prior to this invention, no system was known which satisfactorily met most or all of these requirements.

SUMMARY OF THE INVENTION

According to the invention in its broadest aspect, a retaining wall system having a number of units placed one on top of the other is characterised in that the units are constructed to be capable of inter-engaging one another in a plurality of selected positions so that the angle of the face of the resulting wall to the vertical can be different at different heights.

Also according to the invention, a retaining wall system includes a plurality of blocks laid one upon another, the upper surface of each block being of substantially convex configuration and the lower surface of each block being of substantially complementary concave configuration, the arrangement being such that the blocks engage complementarily in more than one possible relative position and resist being displaced therefrom by lateral forces, and such that the angle of the face of the resulting wall to the vertical can be different at different angles.

The upper and lower surfaces of each block are preferably each based upon the curved surface of a cylinder, the respective cylinder axes being parallel and displaced vertically one from the other by a distance substantially equal to the thickness of the block.

Each block may have a number of alternating ribs and grooves on at least part of its intended upper surface and at least one rib on its intended lower surface, the rib or ribs of the lower surface being dimensioned and positioned to engage complementarily in a plurality of relative positions with the ribs and grooves on the upper surface of the block below.

Further, according to the invention, a unit for a retaining wall system is symmetrical about a fore and aft vertical plane and is elongated on either side of said plane and has respectively substantially complementary convex and concave upper and lower surfaces as seen in a cross-section taken in said plane. In a preferred embodiment of such a unit, each upper surface has a plurality of alternating ribs and grooves over at least a part thereof, and each concave surface has at least one (and preferably two or three) ribs of a size and shape complementary to the grooves on its upper surface.

The word "complementary" when applied to the concave and convex surfaces referred to is intended to imply a sufficient similarity of shape that one unit can rest upon one below it in more than one possible relative position. When applied to the ribs and grooves referred to, it is intended to imply a structure that permits an interdigitating arrangement having the rib or ribs of one unit within the grooves of the other without there being a precise exact fit or an exact correspondence of shape. In other words, there may be tolerance in the dimensions of the ribs and grooves.

Retaining wall systems according to this invention may be of the dry-stack wall type or of the mortar-bedded type, or of a type using mastic or other bedding compositions.

In a preferred embodiment of the invention, each block or unit is made of concrete. The ribs may be substantially flat-sided and flat-topped, with the sides inclined towards each other so that the base of the rib is wider than its top surface. A recess may be (but need not be) provided within the block or in the undersurface of the block if it is desired to reduce the weight of the block. Such a recess, if provided, may extend completely across the width of a unit or block and may be useful as an anchoring location, permitting the use of various known arrangements for tying the wall system back into the fill material. Such a recess may also be useful as a location for lifting especially when mechanical lifting equipment is being used to move the units or construct the wall system.

In an alternative embodiment of the invention, instead of the upper and lower surfaces of the unit being convex and concave and curved in a complementary manner, almost as good a result can be achieved by having these surfaces respectively generally convex and generally concave and having the configuration of a many-sided polygon.

BRIEF DESCRIPTION OF THE DRAWINGS

The invention will be better understood from the following description of illustrative and non-limiting examples thereof, given with reference to the accompanying drawings in which.

DETAILED DESCRIPTION

Figure 1:
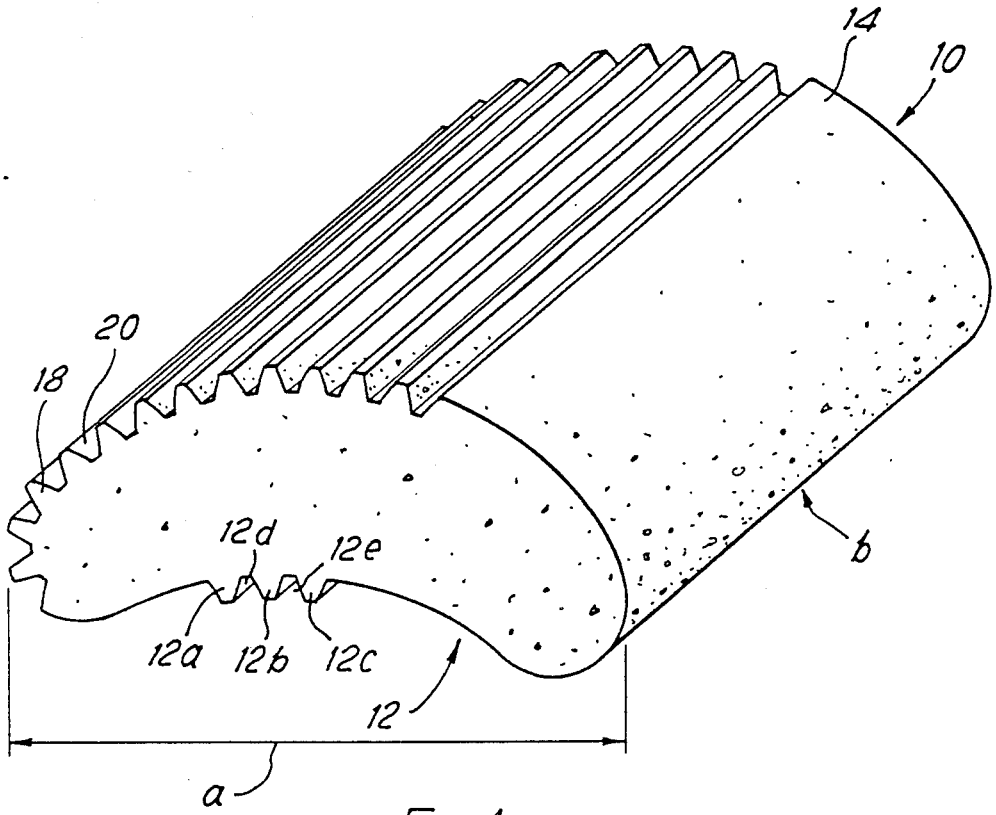
FIG. 1 is a perspective view of one example of a block or unit according to the invention.

Referring now to FIG. 1, the illustrated unit for a retaining wall system is preferably made in the form of a single concrete block 10 and has a substantially concave lower surface 12 and a substantially complementary convex upper surface 14. As seen in cross-section the block can be regarded as approximately banana shaped but it is of course elongated transversely to the plane of the section. In plan, its shape is preferably substantially rectangular. As seen in plan the fore and aft distance is preferably but not necessarily such that the distance (a) is between about 80% and about 200% of the width dimension (b). Units according to the present invention can of course be constructed in any desired sizes, but one possible convenient size is a =0.35 metres and b=0.30 metres with each block having a total weight of about 25 kilogrammes. Units according to the invention may be smaller or larger than this, according to requirements.

Units according to the invention are preferably but need not be solid throughout; as already mentioned, a recess may be included. Alternatively blocks according to the invention may have one or more longitudinal or transverse or otherwise located bores, spaces, or holes to reduce weight or for special reasons. Generally it will be desirable for blocks according to the invention to have significant mass and weight, because the use of too light a block will reduce the long term stability of the resulting retaining wall system.

The ribs 18 and the channels 20 extend over the front surface of the block as seen in FIG. 1, and over a major part of the top surface 14. On the under-surface 12 there are three parallel ribs 12*a*, 12*b*, 12*c* defining two channels 12*d*, 12*e*, these channels being complementary to the ribs on the upper surface 14 and correspondingly the ribs on the lower surface 12 are complementary to the channels on the upper surface. This configuration enables a number of identical or closely similar blocks to be employed together, places one upon another, with confidence that each block will engage each other block to permit the building of a retaining wall system such as is illustrated in any one of FIGS. 3–7. It will be appreciated that while a preferred embodiment of block according to the invention has ribs and grooves as described, these are not essential to the invention.

Figure 2:
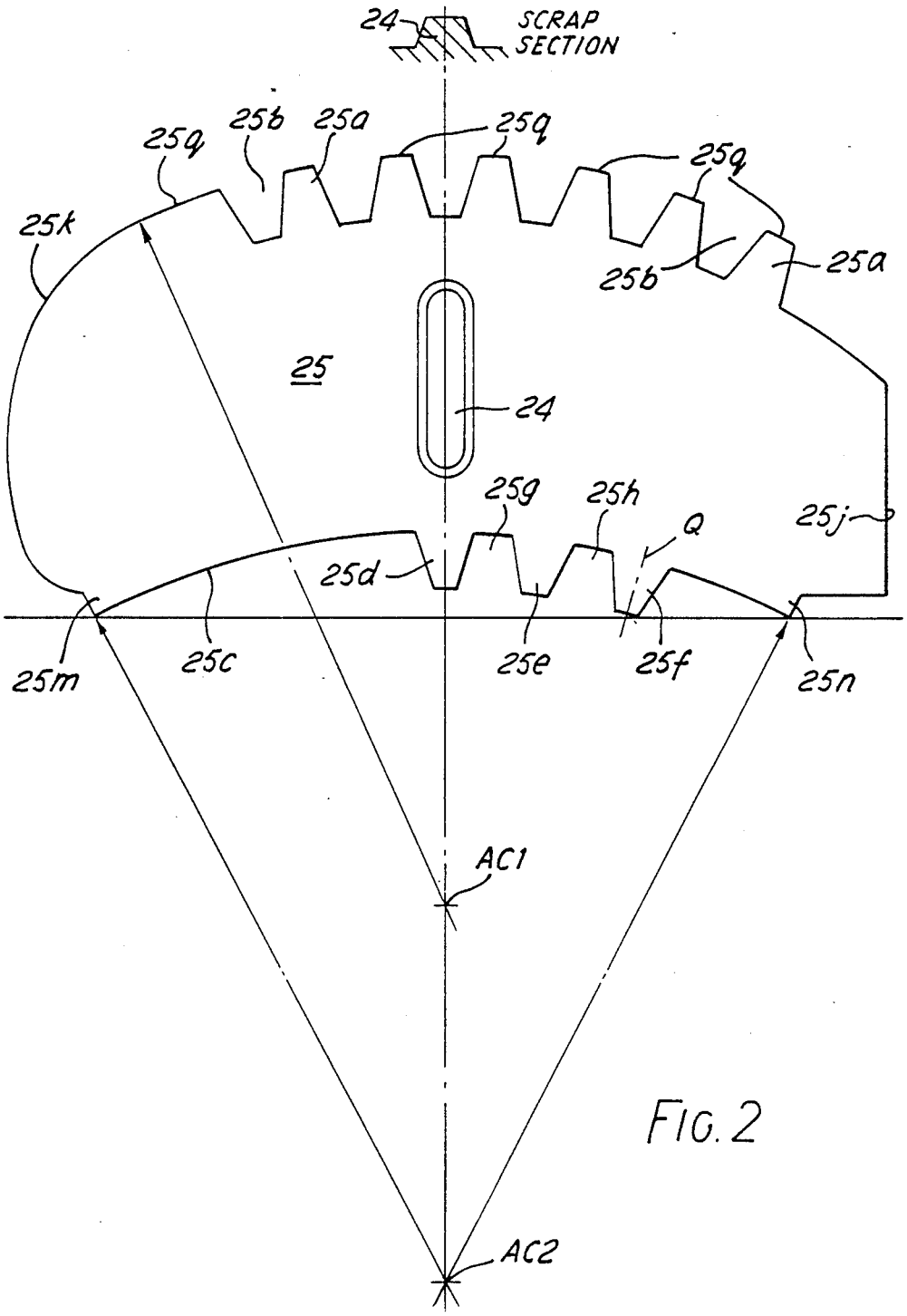
FIG. 2 is an elevation view of one end of a block or unit according to a second example of the invention, shown on an enlarged scale compared to the unit of FIG. 1.

Referring now to FIG. 2, this illustrates a block 25 according to the invention which differs from that shown in FIG. 1 in that it has a spacer stud 24 at one end. This is to facilitate the placing of the blocks. The spacer stud is seen in a scrap horizontal section just above the block 25.

The block 25 has a number of parallel ribs and grooves on its upper and one end surface, the ribs being indicated at 25*a* and the grooves at 25*b*. The concave under surface 25*c* of the block 25 has three ribs thereon, denoted 25*d*, 25*e* and 25*f* with two channels 25*g*, 25*h* separated by the middle rib 25*e* of the three. The reason for providing many more ribs and channels on the upper surface than the lower surface is to permit selection, during erection of the retaining wall, of the angle to the vertical at which a selected block is placed. This will best be understood from a consideration of FIGS. 3–7 and particularly FIGS. 4–6. The block illustrated in FIG. 2 has a substantially vertical rear surface 25*j* and a curved front surface 25*k*. The undersurface 25*l* has two projections 25*m* and 25*n* whose purpose is to allow the block 25 to be laid on a flat horizontal surface without the ribs 25*d*, 25*e* and 25*f* bearing any substantial load. The ribs have preferably flat sides angled to the medial central longitudinal plane Q of the rib; the included angle between the flat sides may be 30 to 38 and preferably 34°. The spacer stud is optional and may be omitted; when used its presence assists in giving the wall a pleasant appearance when seen from the front.

In the most-preferred embodiment of the invention, the major part of the upper surface (indicated 25*q*) is shaped as the curved surface of a cylinder of diameter 300 mm, the axis of the cylinder being shown at AC1; and the major part of the undersurface 25*c* is shaped as the curved surface of a cylinder of the same diameter, the cylinder axis being at AC2. The angular spacing of the ribs is preferably 7.5 degrees. The distance between axes AC1 and AC2 is preferably substantially equal to the block thickness and more preferably, as in the case of the illustrated FIG. 2 block, substantially 150 mm. The overall front-back dimension of the block may be about 350 mm. As stated, seen in plan, the block is preferably rectangular, with its overall fore and aft dimension from 80% to 200% of its overall width dimension.

Figure 3:
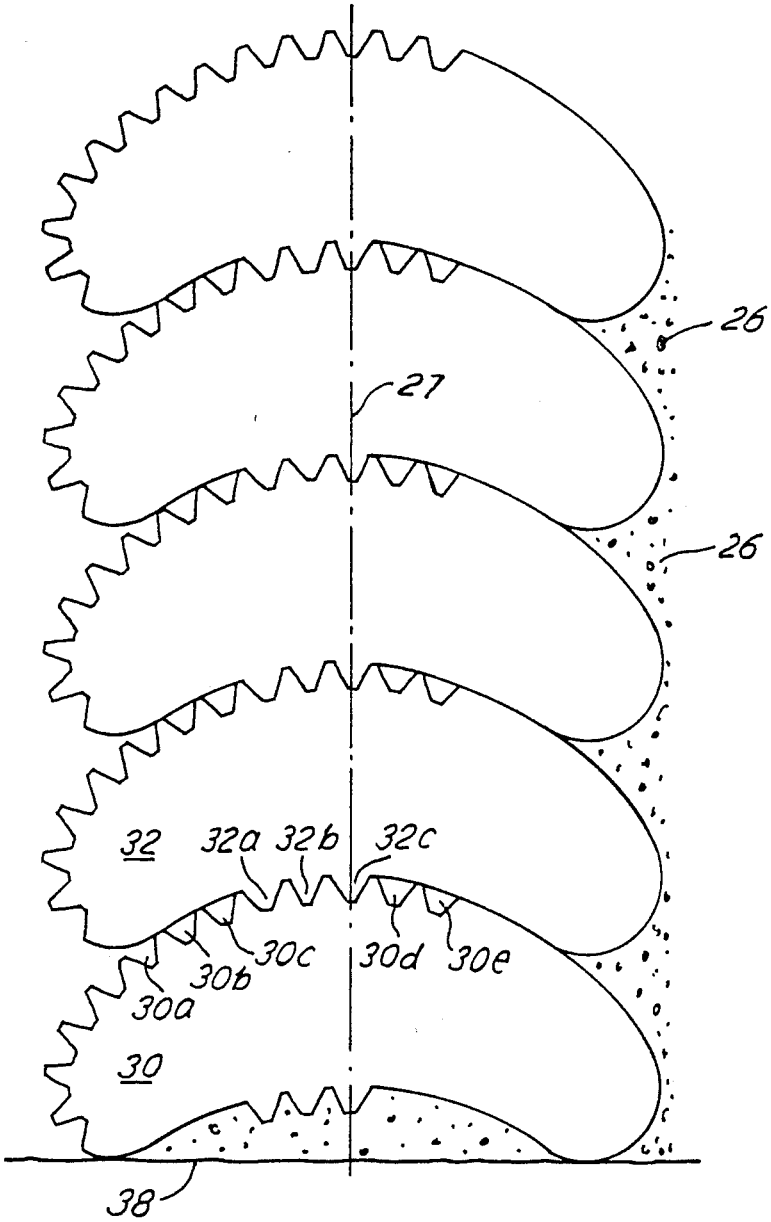
FIGS. 3, 4 and 5 are respective cross-sectional views taken in a vertical plane through retaining walls constructed using blocks according to the first embodiment of the invention, FIG. 3 showing a vertical wall, FIG. 4 showing a wall slanted at about 7.5° to the vertical, and FIG. 5 showing a wall slanted at about 15° to the vertical.
Figure 7:
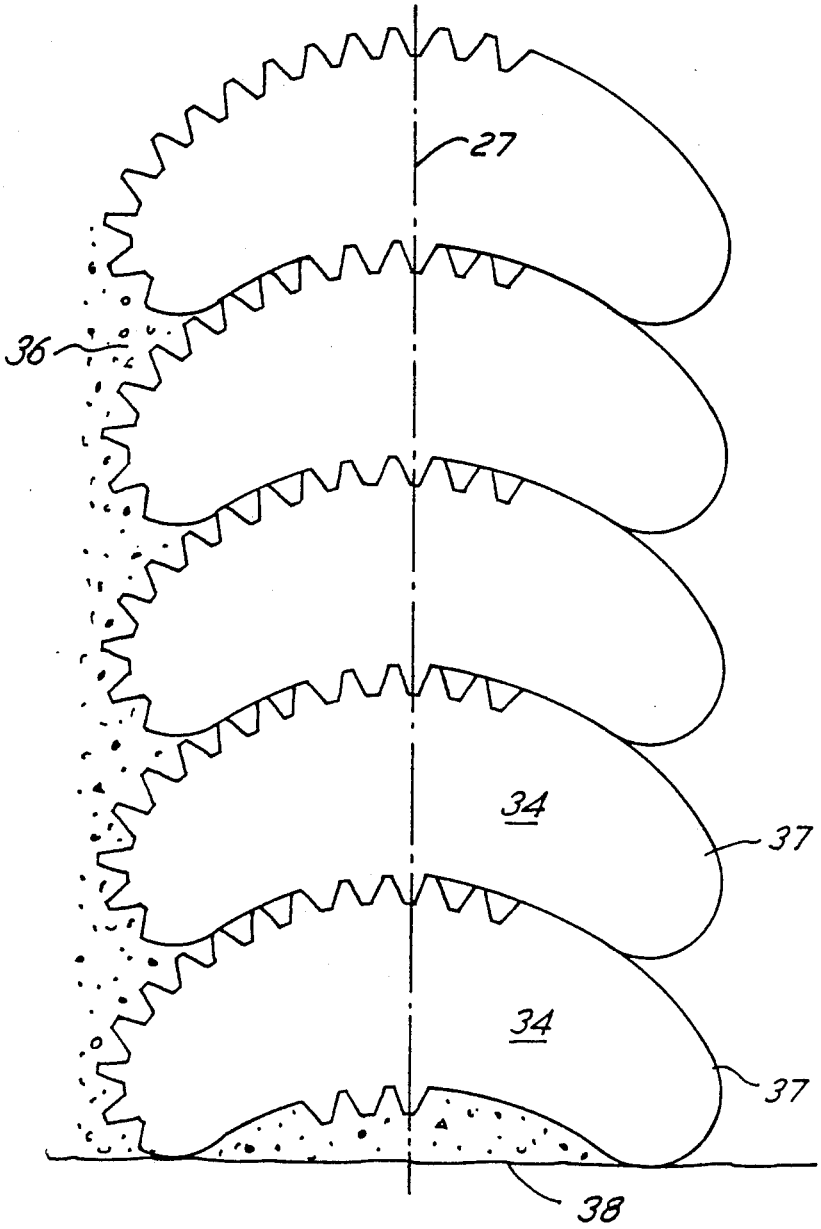

FIGS. 3 and 7 illustrate two versions of a substantially vertical retaining wall, in which the retained earth and soil is seen at 26 and 36. In FIG. 3 the blocks 30 and 32 are arranged one upon each other with the rib and channel portions visible at the front surface. In the arrangement of FIG. 7 the ribs are concealed at the rear in the soil or earth 36, and surfaces 37 (which may be rounded as illustrated or otherwise shaped as may be desired for aesthetic or other reasons) are visible. Equally, the block shown in FIG. 2 may be used either with the rounded surface 25*k* exposed, or with the flat surface 25*j* exposed. The former orientation will be more usual.

Each of FIGS. 3–7 illustrates an important feature of the invention, namely that the blocks according to the invention can be laid on a plain horizontal foundation pad 38. The interengagement between a block and another block on top of it can be seen from looking at blocks 30–32 in FIG. 3. Three parallel ribs 32*a*, 32*b* and 32*c* are provided on the underside of block 32, and these are received by counterpart channels on the upper or convex surface of the block 30. The channels 30*a*, 30*b*, 30*c*, 30*d* and 30*e* of block 30 are not occupied by any ribs. The constructions shown in FIGS. 3 and 7 yield a vertical wall and the medial planes 27 of all the blocks are coplanar. The arrangement of wall system shown in FIG. 7 is similar in that the blocks are arranged to give a substantially vertical wall, but in this instance the exposed surfaces of the blocks are smooth rounded surfaces 37, and the rib and channel surfaces at the rear of the blocks are embedded in the retained earth or soil 36. A horizontal foundation pad 38 is employed.

Figure 4:
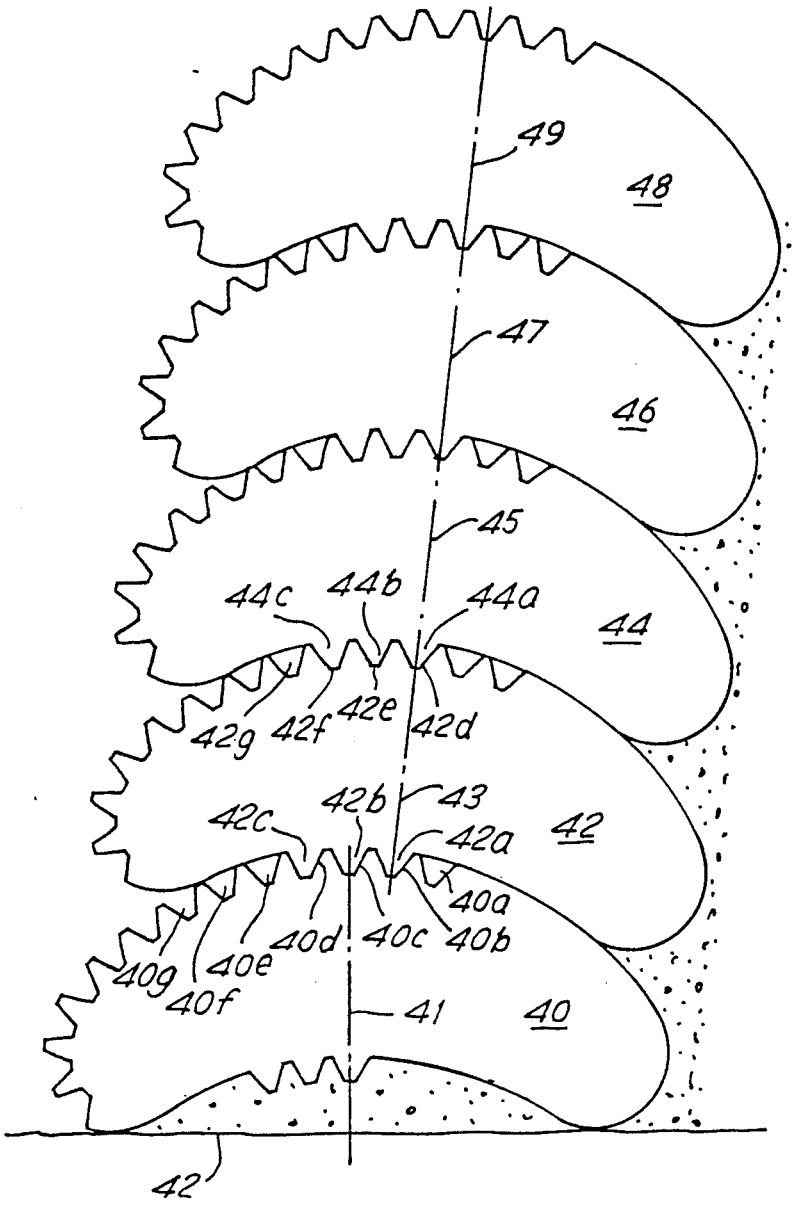

In FIG. 4 the lowermost block 40 is laid upon a horizontal foundation pad 42 and the convex surface of the block 40 has channels 40*a*, 40*b*, 40*c*, 40*d*, 40*e*, 40*f*, 40*q* etc. The three ribs 42*a*, 42*b*and 42*c* on the concave or undersurface of the block 42 are engaged in the channels 40*b*, 40*c* and 40*d* so assuring that the medial plane (in a front and rear direction of the block 42, said plane being indicated at 43) is disposed at a desired angle (e.g. substantially 7.5° ) to the vertical. Of course, in a case where ribs and grooves are employed, this angle is determined by the spacing of the ribs and it is within the scope of the present invention to employ different angles. The medial plane 41 of the block 40 is located substantially vertical. It will be realised that in an embodiment of the invention in which ribs and grooves are not employed, one block can be placed on another in such a way as to provide a retaining wall whose slope to the vertical changes at different levels by small amounts, there being no restriction imported by the presence of ribs and grooves.

The three ribs 44*a*, 44*b* and 44*c* of the block 44 extend into counterpart channels 42*d*, 42*e* and 42*f* of the block 42, so orienting the block 44 that its medial plane 45 is substantially coincident with the medial plane 43 of the block 42. The blocks 46 and 48 are placed in turn upon the block beneath them in a similar manner, their medial planes 47 and 49 being coplanar with the planes 43 and 45.

Figure 5:
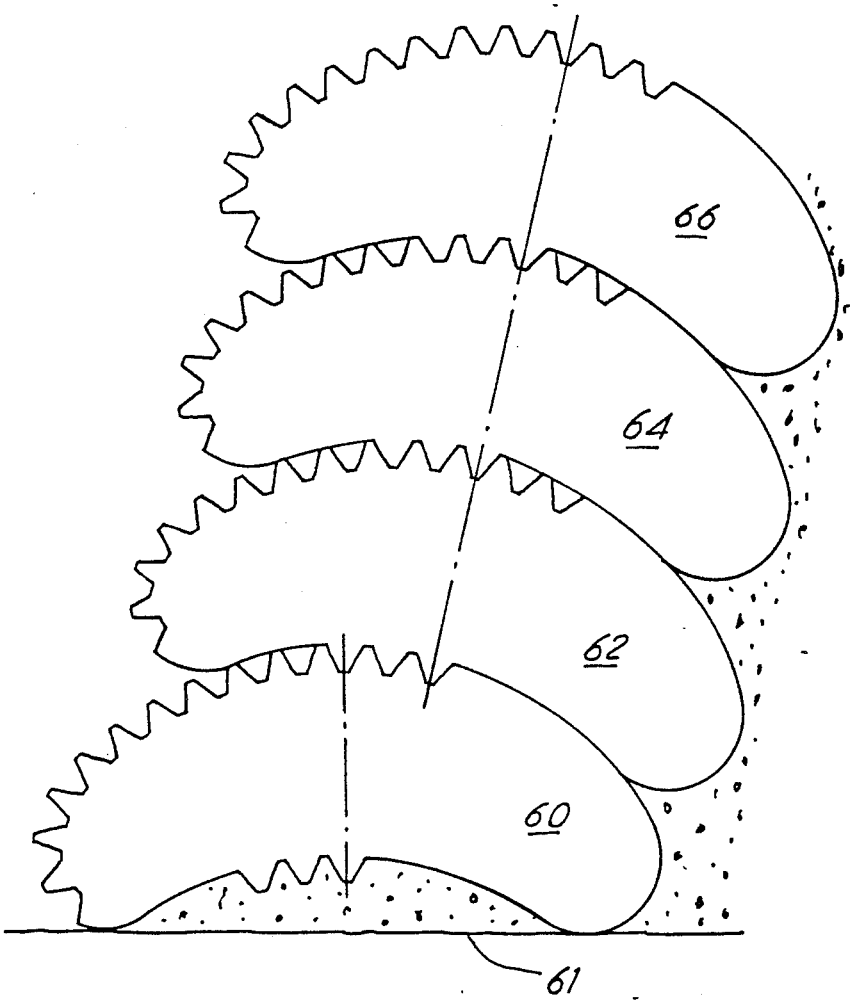

FIG. 5 illustrates a similar but not identical arrangement wherein the block 66 placed upon block 64 has its three ribs placed in the third to fifth channels on the upper surface of the block 64, and a similar mutual interengagement exists between the blocks 64 and 62. The block 62 is placed on the lowermost block 60 is such a way that the blocks 62–64 define a retaining wall at substantially 15° to the vertical. As before, the block 60 is laid upon a plain horizontal foundation pad 61.

Figure 6:
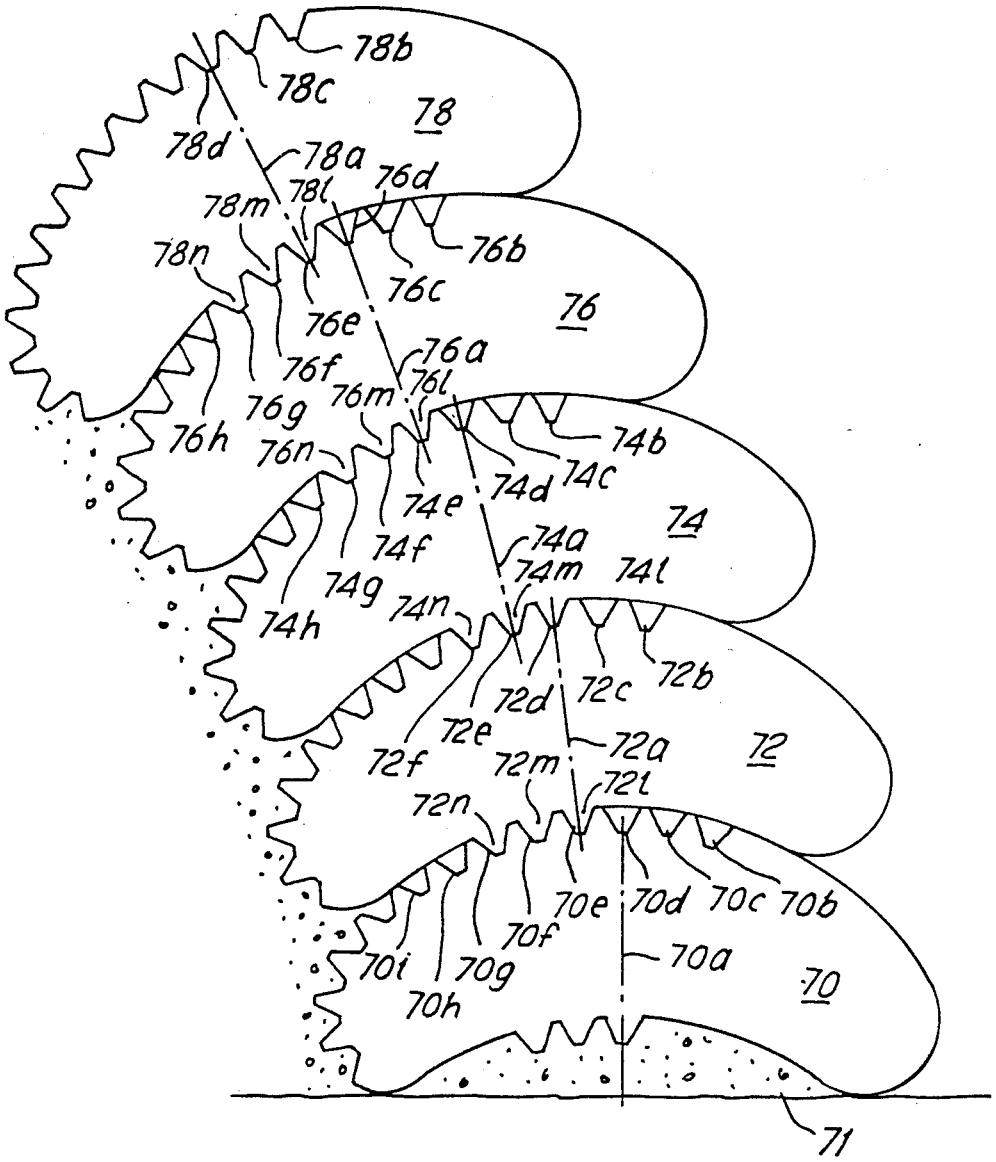
FIGS. 6 and 7 are respective cross-sectional views taken in a vertical plane showing, in FIG. 6, how a retaining wall can be constructed to have a steadily increasing rearwards tilt, and FIG. 7 showing a substantially vertical retaining wall with the units thereof located so that their rounded surfaces are visible as opposed to having their ribbed surfaces visible.

FIG. 6 illustrates an alternative construction which allows a retaining wall to slope back at an increasing angle. FIG. 6 illustrates blocks 70, 72, 74, 76 and 78 resting one upon another with the lowermost block 70 supported by a plain horizontal foundation pad 71. The respective central medial planes are indicated at 70*a*–78*a*. The respective parallel channels of the convex upper surface of the block 70 are indicated 70*b*–70*i*, and like channels in the other blocks are similarly referenced. As seen from FIG. 6, the ribs 72*l*, *m* and *n* on the concave under surface of block 70 extend into channels 70*e*, 70*f* and 70*g* respectively of block 72. The ribs 74*l*/74*m* and 74*n* extend into channels 72*c*, *d* and *e*. The ribs 76*l*, *m* and *n* of block 76 extend into the channels 74*e*, 74*f* and 74*g* of the block 74. The ribs 78*l*, 78*m* and 78*n* extend into and engage with the channels 76*e*, 76*f* and 76*g* of the block 76. In this arrangement, the medial planes 70*a*–78*a* are disposed at successively increasing angles to the vertical.

It will be realised that the construction of unit according to the present invention permits the units making up a retaining wall system to be located so that the resulting wall can have a variety of configurations, both as seen in vertical cross-section and in plan. For example, if desired the unit placed upon unit 78 could be placed so that its three ribs engage with and enter into the channels 78*b*, 78*c* and 78*d*, if it was desired to reduce the backward slope of the wall at a higher region of the wall. To the best of Applicant's knowledge and belief, there is no retaining wall system known which permits such a variety of choice while only requiring one single type of block.

As particularly described and illustrated with reference to those embodiments of the invention which include ribs and grooves, the "pitch" or angular spacing between adjacent ribs, or between the centres of adjacent channels, has been suggested to be 7.5° , this being the angle subtended at the centre of a circle whose periphery follows the broad outline of the convex surface of the block concerned. However, while this is a convenient value for the subtended angle, it may take other values without departing from the invention. In practice, it is preferred to choose an angle which permits adequate quantity of concrete to be present in each rib so as to reduce the possibility of a rib being broken off, and this consideration suggests a practical minimum of a subtended "pitch" angle of about 5° . If the chosen angle is greater than about 7° or 8° then the possible slopes of wall achievable are reduced in number.

In an alternative embodiment of the invention, a retaining wall can be built which is slightly curved as seen in plane. This can be achieved by using blocks substantially as illustrated in FIG. 2 but having the rib 25*e* of a lesser length than the full width of the block. That is to say, the two end portions of rib 25*e* are omitted which permits one block to take up a position at a slight angle, e.g. up to about 3 or 4 degrees as seen in plan to an adjacent block with which its ribs and grooves engage.

What is claimed is:

1. A wall unit for use in a retaining wall system, the unit consisting of a block having an overall singularly arcuate profile and including arcuate upper and lower surfaces, the unit also being symmetrical about a fore and aft vertical plane and being elongated on either side of said plane, and the said upper surface of the unit being convex and the lower surface being concave, both as seen in a cross-section taken in said vertical plane, the said convex and concave surfaces being defined by respective arcs of circles having equal diameter and centers located exteriorly of the unit, and wherein said upper surface has a plurality of alternating ribs and grooves over at least a part thereof, and said lower surface has at least one rib extending therefrom of a size and shape complementary to the grooves on said upper surface.

2. A wall unit according to claim 1, wherein the block is generally rectangular in plan view.

3. A wall unit according to claim 2, in which the fore and aft dimension in plan view is from 80 to 200% of its width in plan view.

4. A wall unit according to claim 1, comprising a front surface which is curved as seen in vertical cross-section and a rear surface which is substantially planar and substantially vertical.

5. A wall unit according to claim 4, comprising substantially planar end walls upon one of which is located a spacer stud.

6. A retaining wall system including a plurality of blocks laid one upon another and each having an overall singularly arcuate profile, the upper surface of each block being of substantially convex and arcuate configuration and the lower surface of each block being of substantially complementary concave and arcuate configuration, each block having a number of arcuately disposed and regularly angularly staggered alternating ribs and grooves on at least part of its said upper surface and at least one rib means on its said lower surface dimensioned and positioned for engaging complementarily in any one of a plurality of relatively angularly shifted positions in a respective groove in the upper surface of the block below, whereby the angle of the face of the resulting wall to the vertical can be different at different heights of the wall, and said convex and concave surfaces being defined by respective arcs of circles having centers located exteriorly of the block.

7. A retaining wall system according to claim 6, wherein the blocks are each substantially rectangular in plan view.

8. A retaining wall system according to claim 7, in which each block as seen in plan has a fore and aft dimension which is from 80 to 200% of its width.

9. A retaining wall system according to claim 6, in which each rib is substantially flat-sided and flat-topped, with the sides inclined towards each other so that the base of the rib is wider than its top surface.

10. A retaining wall system according to claim 6, in which the flat sides of the ribs are inclined so that they enclose an angle of from 7 to 8 degrees.

11. A wall unit for use in a retaining wall system, the unit consisting of a block having an overall singularly arcuate profile and upper and lower surfaces, said surfaces being convex and concave, respectively, and defined by respective arcs of circles having equal diameter and centers located exteriorly of the unit, and one of said surfaces having a plurality of arcuately disposed and regularly angularly staggered alternating ribs and grooves and the other of said surfaces having at least one rib having a configuration complementary to at least a plurality of said grooves, whereby the unit may be laid atop a like unit and interengaged at any one of plural relatively rotated positions.

12. A wall unit according to claim 11, wherein there are a plurality of ribs on said other of said surfaces each having a configuration complementary to at least a plurality of said grooves.

13. A wall unit according to claim 12, wherein said other of said surfaces is concave and said ribs on said concave surface are contained within the chordal segment defined by said concave surface.

14. A wall unit according to claim 11, wherein said block has a rounded front end and a flat rear end.

* * * * *